US011162238B2

(12) United States Patent
Halonen

(10) Patent No.: US 11,162,238 B2
(45) Date of Patent: Nov. 2, 2021

(54) LOWER CUSHION OF A PILE DRIVING RIG

(71) Applicant: Junttan Oy, Kuopio (FI)

(72) Inventor: Antti Halonen, Lapinlahti (FI)

(73) Assignee: Junttan Oy, Kuopio (FI)

( * ) Notice: Subject to any disclaimer, the term of this patent is extended or adjusted under 35 U.S.C. 154(b) by 0 days.

(21) Appl. No.: 16/464,353

(22) PCT Filed: Nov. 30, 2016

(86) PCT No.: PCT/FI2016/050845

§ 371 (c)(1),
(2) Date: May 28, 2019

(87) PCT Pub. No.: WO2018/100228

PCT Pub. Date: Jun. 7, 2018

(65) Prior Publication Data

US 2020/0283982 A1 Sep. 10, 2020

(51) Int. Cl.
*E02D 13/10* (2006.01)

(52) U.S. Cl.
CPC ..... *E02D 13/10* (2013.01); *E02D 2300/0006* (2013.01)

(58) Field of Classification Search
CPC ..... E02D 13/10; E02D 13/00; E02D 7/02
USPC ..... 405/232; 404/32, 33
See application file for complete search history.

(56) References Cited

U.S. PATENT DOCUMENTS

| | | | | |
|---|---|---|---|---|
| 1,060,668 | A | 5/1913 | Crawshaw | |
| 4,479,552 | A * | 10/1984 | Chappelow, Jr. | E02D 13/10 173/131 |
| 2009/0200241 | A1* | 8/2009 | Harman | B01D 12/00 210/693 |
| 2010/0126746 | A1* | 5/2010 | Robson | B25D 17/08 173/211 |

FOREIGN PATENT DOCUMENTS

| | | | |
|---|---|---|---|
| FR | 2157292 | A5 | 6/1973 |
| JP | H01163317 | A | 6/1989 |
| RU | 2059045 | C1 | 4/1996 |
| SU | 514061 | A1 | 5/1976 |
| SU | 1553609 | A1 | 3/1990 |

OTHER PUBLICATIONS

Grutman M. S. Piled foundations, Kiev, Budivelnik, 1969, 27 p.
Russian Patent Office, Application No. 2019120019, Decision to grant, dated Feb. 25, 2020, 6 pages.

* cited by examiner

*Primary Examiner* — Sean D Andrish
(74) *Attorney, Agent, or Firm* — MacMillan, Sobanski & Todd, LLC

(57) ABSTRACT

A pile driving rig lower cushion made of material having elasticity modulus of 500-3500 Mpa. The lower cushion comprises two end surfaces and at least one side surface. The first end surface is to be placed against the drive cap of the pile driving rig. The second end surface is to be placed against the end of a pile. The lower cushion has at least one flexible section at the side surface that is more flexible than remaining sections of the side surface in at least one direction. The dimensions of the lower cushion are such that the lower cushion fits snugly into the drive cap housing only when the flexible area is compressed. The lower cushion remains in its place within the drive cap housing due to (Continued)

compressive force caused by the at least one flexible section and friction forces resulting therefrom.

10 Claims, 5 Drawing Sheets

LOWER CUSHION OF A PILE DRIVING RIG

PRIORITY

This application is a U.S national application of the international application number filed on PCT/FI2016/050845 filed on Nov. 30, 2016, the content of which is incorporated herein by reference in its entirety.

OBJECT OF THE INVENTION

The object of the invention is a pile driving rig lower cushion.

BACKGROUND OF THE INVENTION

The lower cushions used today are pieces of suitable shape and size, primarily made of wood (e.g. birch or beech), which are fitted into the drive cap housing, between the pile and the drive cap located above the drive cap housing. The purpose of the lower cushion is to reduce the compressive stress peak of the first shock wave following the blow, which otherwise might cause the end of the pile to crumble, thus damaging the pile so as to make it unfit for use.

The problem with a lower cushion made of wood is that it starts to heat up as the pile driving proceeds, and often it eventually catches fire. Naturally this should not happen because of the fire hazard (in particular on oil or gas fields, for example, where it is strictly prohibited to make an open fire, however small). In addition, when burning, the lower cushion becomes carbonized and its properties change. Furthermore, a wooden lower cushion loses its flexibility in any case, usually during the driving of one pile or, in the worst-case scenario, even partway through driving the same pile. Therefore, when using lower cushions made of wood, there must be a large quantity of them on the worksite. Replacing them uses up work time and thus slows down the progress of the pile driving work. In particular, if the lower cushion must be replaced partway through driving the same pile, it is detrimental, because then the hammer must be lifted off from on top of the pile partway through driving the pile. In addition, a large quantity of lower cushions made of wood must be transported to the worksite and stored there during the pile driving work.

Lower cushions made of plastic or similar material have also been tried. However, the problem with them is that it is difficult to make a lower cushion with suitably sized material properties remain in place in the drive cap housing at the stage when the pile has not yet been installed in its place in the drive cap housing. At that stage, the hammer and the drive cap housing located therein are, before starting the pile driving, high in the upper part of the leader, but the pile is not there to support the lower cushion from below. A lower cushion falling down from the upper part of the leader (from a height of up to 30 metres) causes a significant safety risk for the persons around the pile driver.

SHORT SUMMARY OF THE INVENTION

The purpose of the invention is to achieve a pile driving rig lower cushion that has a longer useful life than wooden lower cushions but that can be kept safely and securely in place in the drive cap housing before fitting the pile into the drive cap housing.

The purpose of the invention is achieved through a pile driving rig lower cushion that has been manufactured from a material whose modulus of elasticity is 500-3,500 MPa and whose flexibility has been locally increased at least in one direction such that the lower cushion can be compressed in said at least one direction such that it fits inside the drive cap meant for it, between at least two opposite interior surfaces located therein and remains, through the effect of the friction forces created by the compressive force exerted on these surfaces from the lower cushion, safely in the drive cap housing and securely in place also when the pile is not fitted in the drive cap housing. To put it more precisely, the pile driving rig lower cushion according to the invention is characterized by what has been presented in the claims.

The advantage of the pile driving rig lower cushion according to the invention is that it eliminates the fire risks associated with lower cushions realized in the known manner, the replacement of the wooden lower cushions that slows down the pile driving process and the need to transport and store large quantities of lower cushions in the worksite area to be piled. In addition, compared to known lower cushions made of plastic, there is the advantage that the lower cushion does not cause safety risks because it remains in the drive cap housing also when the pile is not fitted in the drive cap housing (usually when the driving of the pile into the ground is started).

DESCRIPTION OF THE DRAWINGS

In the following, the invention is described in more detail with reference to the appended drawings, in which.

DETAILED DESCRIPTION OF SOME ADVANTAGEOUS EMBODIMENTS OF THE INVENTION

Figure 1:
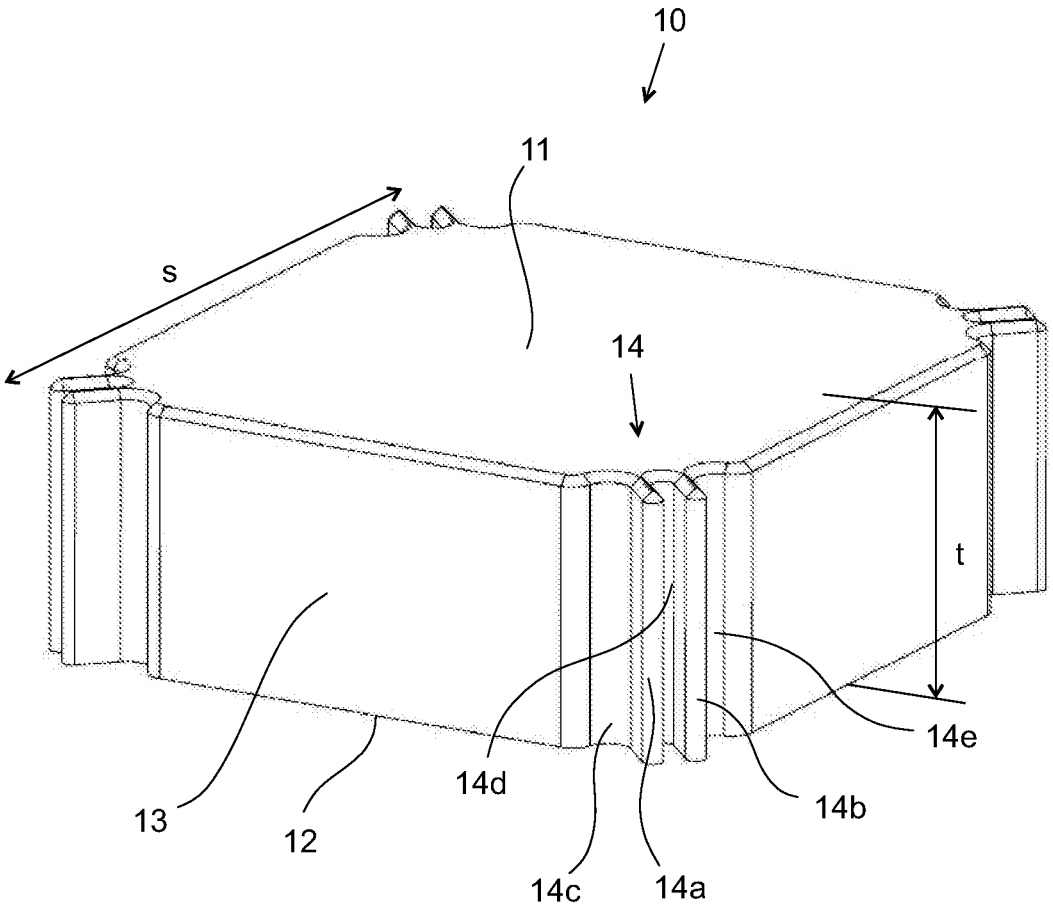
FIG. 1 is an oblique top view of a pile driving rig lower cushion according to the invention.
Figure 2:
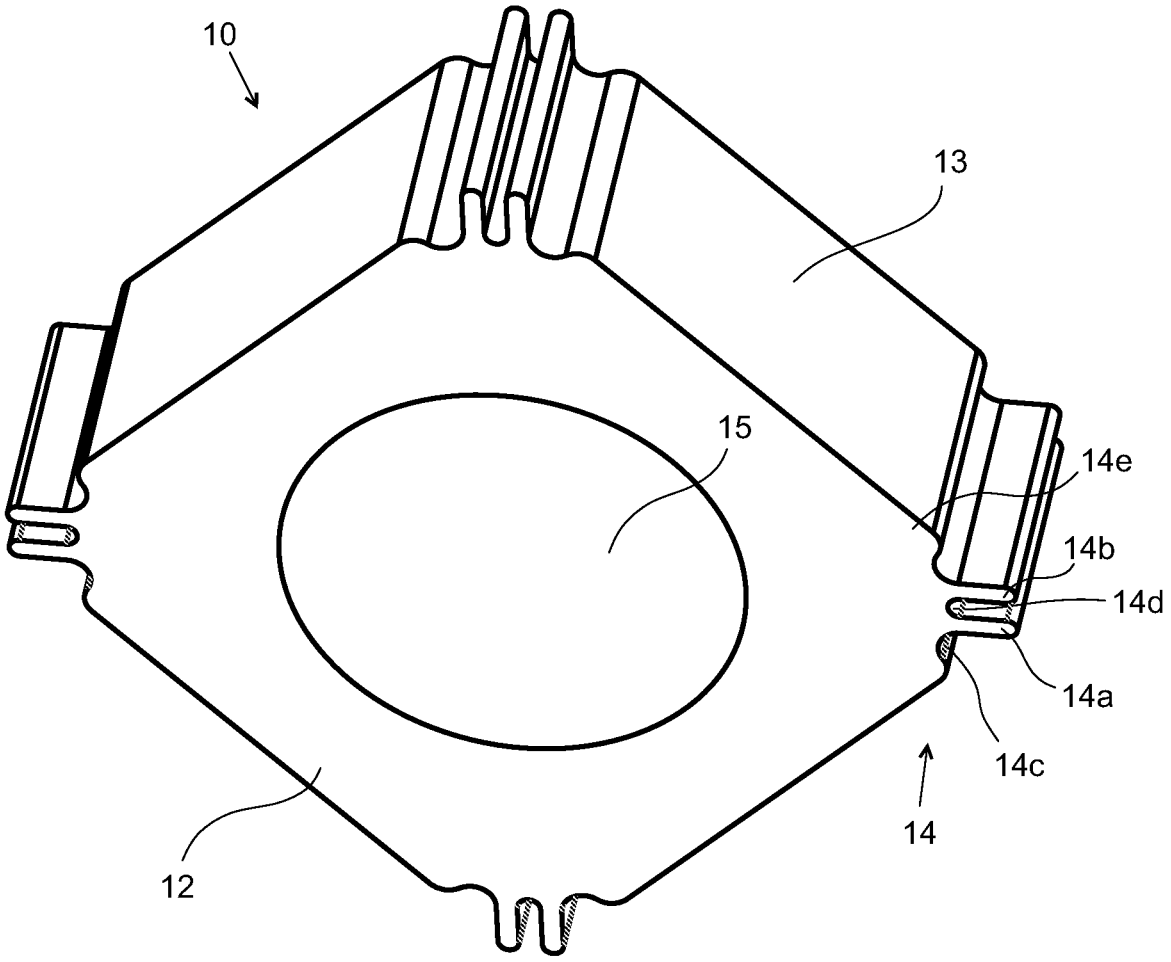
FIG. 2 is an oblique bottom view of the lower cushion according to FIG. 1

FIGS. 1-5 show a pile driving rig lower cushion 10 according to the invention, which, in this case, has been made of plastic whose modulus of elasticity is comprised between 500 and 3,500 MPa and which is a single piece made of monomaterial. The lower cushion 10 shown in FIGS. 1-5 has been designed so that it can be fitted, in the manner shown in FIGS. 4 and 5, inside the drive cap housing 30 with a rectangular cross section located in the lower part of the pile driving rig hammer, such that its first end surface, i.e., in this case, top surface 11 comes against the drive cap (not shown in the figures) located above the drive cap housing and the other end surface 12, i.e., in this case, the bottom surface, comes against the end of the pile to be fitted into the drive cap housing 30. In this embodiment, the bottom surface 12 has a concave (spherically shaped) recess 15 for a protrusion with a corresponding shape located at the upper end of the pile. The perpendicular distance between the top surface 11 and the bottom surface 12, i.e. the thickness t of the lower cushion 10, is determined, in the lower cushion according to FIGS. 1-5, based on the modulus of elasticity of its material and on how intense the blows and how much the lower cushion 10 should dampen these blows.

The side surfaces 13 between the corners 14 of the lower cushion 10 are at right angles in relation to their adjacent side surfaces 13 (in other words, the lower cushion 10, seen from above, is rectangular for this part and since all the sides are of equal length in this case, it is also square in terms of its cross-section measurements). The two flexible protuberances 14*a* and 14*b* located at each corner 14 of the lower cushion 10 have been achieved in the lower cushion 10 preferably using manufacturing techniques i.e. means enabled by the manufacturing method of the lower cushion. In this embodiment, the flexibility-enhancing property of the flexible protuberances 14*a* and 14*b* located in the corners 14 is based on the bending of the two flexible protuberances 14*a* and 14*b* located in every corner 14 when the lower cushion is fitted in the drive cap housing 30. Thereby two adjacent interior surfaces 31*a* of the side edges 31 of the drive cap housing 30 compress them obliquely (at an angle of around 45°) towards one another. Therefore, in this embodiment, the flexible section of the lower cushion 10 is formed by the areas located in each corner 14 of the lower cushion 10 which have two flexible protuberances 14*a*, 14*b* and recesses 14*c*, 14*d* and 14*e* located around them. Forced by the adjacent interior surfaces 31*a* of the drive cap housing 30, the flexible protuberances 14*a* and 14*b* bend into the above-mentioned direction whereby they, on the other hand (due to their flexibility), become compressed against the side walls 31 of the drive cap housing. The dimensioning of the flexible protuberances 14*a* and 14*b* has been implemented such that the friction forces prevailing at the contact point between them and the interior surfaces 31*a* of the side walls 31 of the drive cap housing 30 are sufficient to secure the lower cushion 10 in its place in the drive cap housing 30 even if the pile is not fitted in the drive cap housing 30.

The outer dimensions of the lower cushion 10 have been determined such that the distance between the opposite side surfaces 13 of the lower cushion 10 corresponds to or is slightly smaller than the distance between the opposite interior surfaces 31*a* of the drive cap housing 30, such that the lower cushion 10 fits, everywhere else other than the flexible protuberances 14*a*, 14*b*, easily movably inside the drive cap housing 30. The modulus of elasticity of the plastic used in the lower cushion 10 is comprised in the range of 500-3,500 MPa, advantageously, for example, 1,500 MPa, in which case it dampens the shock wave caused by the block moving inside the hammer suitably, however not in such a manner that it would return too much impact energy back to the hammer.

The shape shown in FIGS. 1-5 is achieved for the lower cushion 10 by, for example, manufacturing it in a mould, using casting technology, by injection moulding or by, for example, 3D printing a plastic piece with the shape shown in the figures, whose corners 14 have the flexible protuberances 14*a*, 14*b* shown in FIGS. 1-5 as well as recesses 14*c*, 14*d* and 14*e*. It is also possible to achieve the lower cushion 10 according to FIGS. 1-5 such that recesses 14*c*-14*e* corresponding to the flexible protuberances 14*a*, 14*b* shown in FIGS. 1-5 are machined in a cast, injection-moulded or 3D-printed blank whose outer dimensions are determined by the flexible protuberances 14*a*, 14*b*. The lower cushion 10 according to FIGS. 1-5 can thus be manufactured, for example, from an initially rectangular piece of plastic by machining its side surfaces 13 and corners 14 in a suitable manner.

The lower cushion 10 according to FIGS. 1-5 is meant to be fitted into the drive cap housing of a hydraulic hammer intended for driving into the ground reinforced concrete or steel piles having a rectangular cross section. At the flexible protuberances 14*a*, 14*b* located in the corners 14, the diagonal D' between the corners 14 shown in FIG. 4, determined according to the flexible protuberances 14*a* and 14*b*, is slightly larger than the corresponding diagonal D of the corners between the interior surfaces 31*a* of the drive cap housing 30. Therefore, when the lower cushion 10 is fitted into the drive cap housing 30, its flexible protuberances 14*a* and 14*b* bend against one another in the manner shown in FIG. 5. As a result of the bending, the diagonal D' of the flexible protuberances 14*a* and 14*b* of the lower cushion decreases such that it is the same as the diagonal D between the corners between the interior surfaces 31*a* of the drive cap housing 30. For this reason, it can be thought that the effective direction of bending of the lower cushion 10 is parallel to the distance between its opposite corners 14 (i.e. diagonal), even though, in fact, the flexible protuberances 14*a* and 14*b* located in the corners 14 deflect by bending towards one another, pushed by the interior surfaces 31*a* of the walls 31 of the drive cap 30.

When compressed against the interior surfaces 31*a* of the walls 31 of the drive cap housing 30, a compressive force P is created between the flexible protuberances 14*a* and 14*b* and the interior surfaces of the drive cap housing 30. The compressive force P creates, between the flexible protuberances 14*a* and 14*b* and the interior surfaces 31*a* of the walls 31 of the drive cap housing 30, a friction force thanks to which the lower cushion 10 remains in its place in the drive cap housing 30, even if there were no pile below it to support the lower cushion 10 from its bottom surface 12. To achieve this, the friction force caused by the flexing of the flexible protuberances 14*a* and 14*b* must be at least large enough to prevent the lower cushion 10 from moving inside the drive cap housing 30, even though it is pulled downwards by the gravity $G_{ap}=m_{ap}*g$ of its lower cushion. Typically (depending on the size of the drive cap housing and the pile), the mass $m_{ap}$ of the lower cushion 10 according to FIGS. 1-5 is approx. 10-20 kg depending on the cross-section dimensions of the pile and, among other things, on the size of the hammer it is intended to be used as a lower cushion for. After determining the friction coefficient μ between the lower cushion 10 and the interior surfaces of the walls 31 of the drive cap housing 30, it is possible to dimension the width and length of the flexible protuberances 14*a* and 14*b* through calculations such that the necessary compressive force P is created through the flexible protuberances 14*a* and 14*b* at least between two corners 14 of the lower cushion 10. On the other hand, if all four corners participate in supporting the lower cushion (such as in the embodiment according to FIGS. 1-5), the necessary compressive force P can, in principle, be halved from the value obtained in this way.

Figure 3:
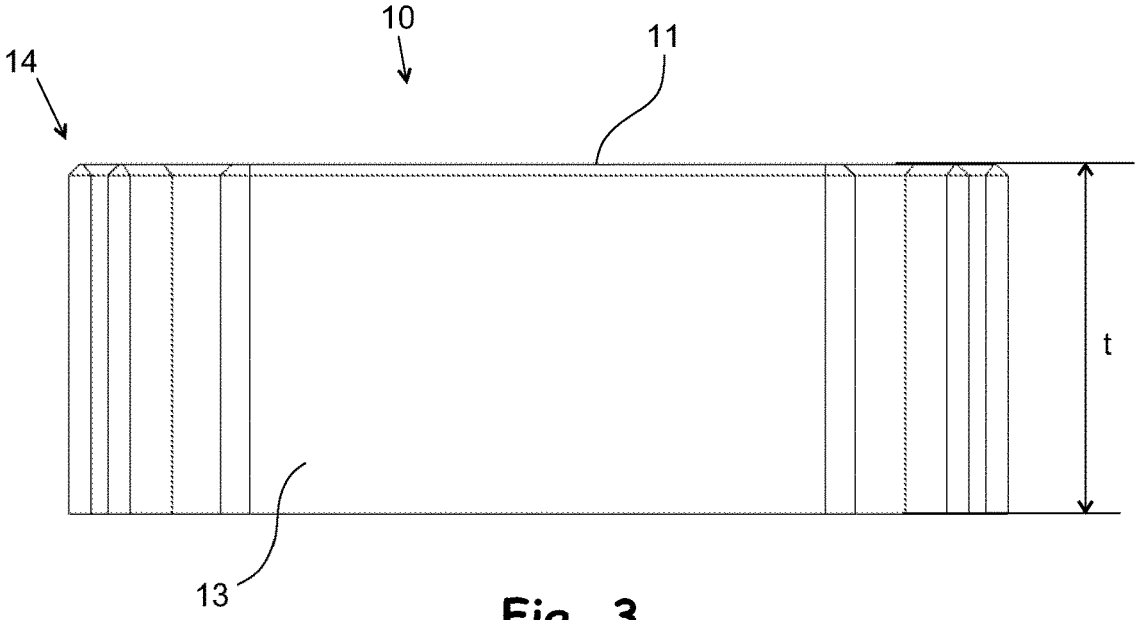
FIG. 3 is a side view of the lower cushion according to the preceding figures.
Figure 4:
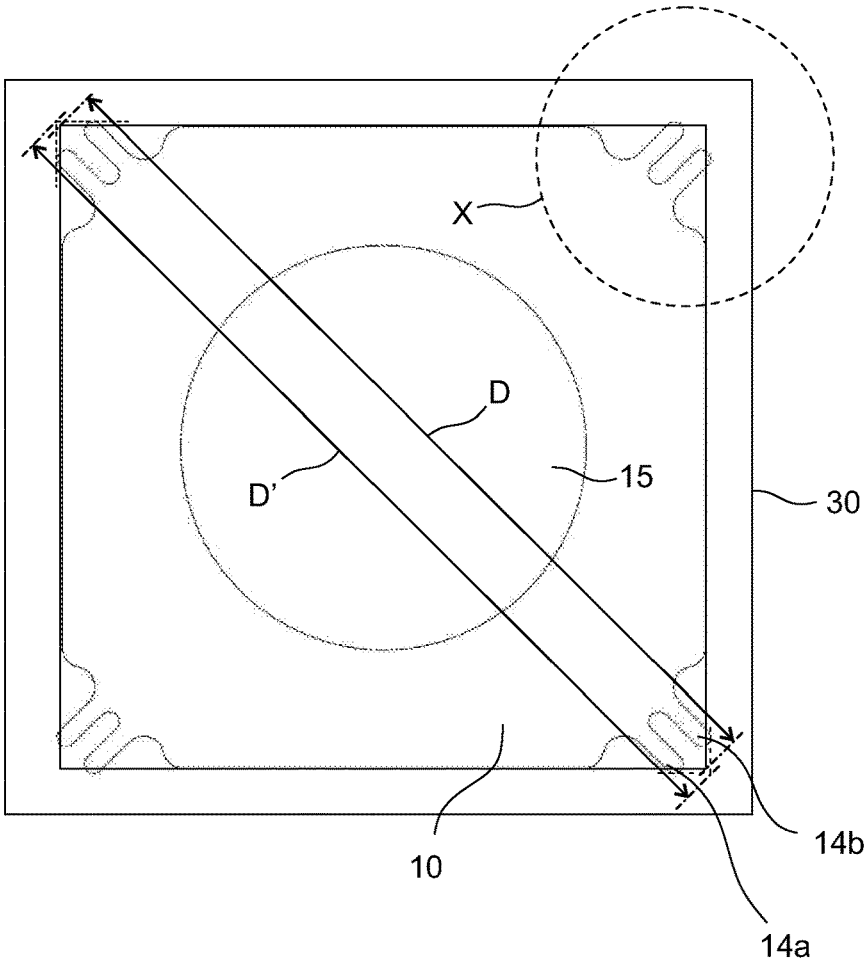
FIG. 4 is a bottom view of the contours of the side surfaces and corners of the lower cushion located outside the drive cap housing according to FIGS. 1-3 in relation to the drive cap housing.

FIGS. 1 and 3 show the dimension t, parallel to the blow direction, i.e. the thickness, of the lower cushion 10. The suitable thickness t for the lower cushion 10 can advantageously be determined according to the modulus of elasticity E of the material of the lower cushion 10, such that the same compressive stress $\sigma_p$ prevailing in the direction of thickness of the lower cushion always creates essentially the same amount of compression (i.e. deflection) ΔT, even though the material of the lower cushion 10 and thus the modulus of elasticity E were to be changed. The deflection ΔT achieved through a compressive force $F_p$ of a certain magnitude in the lower cushion 10, the cross-section area of which is A, thickness t and modulus of elasticity is E and which is subject to a compressive force $F_p$, can be calculated using the following formula:

$$\Delta T = t \cdot \varepsilon = t \cdot \frac{\sigma_p}{E} = t \cdot \frac{F_p}{A \cdot E} \quad (1)$$

where

ΔT is the deflection of the lower cushion t is the thickness of the lower cushion ε is the relative elongation $\sigma_p$ is the compressive stress prevailing in the lower cushion $F_p$ is the compressive force exerted on the lower cushion A is the surface area of the cross section of the lower cushion E is the modulus of elasticity of the lower cushion Consequently, if the dimensions of a lower cushion 10 according to FIGS. 1-5, made, for example, of the material $M_1$ and essentially square in terms of its cross section, would be the following: Side length s=320 mm (in which case the cross-section area A=102,400 $mm^2$), thickness $t_1$=100 mm and modulus of elasticity $E_1$=1,100 MPa. In addition, if it is known that, at the moment of the blow, a compressive force $F_p$=5 MN that is evenly distributed across the area of the horizontal cross section of the lower cushion, is exerted on the lower cushion 10 through the impact of the block, the weight of the hammer and the possible hammer pull-down. In this case, the deflection $\Delta T(E_1)$ of the lower cushion made of the material M1, determined using formula 1≈4.4 mm. However, if the modulus of elasticity of a lower cushion with a corresponding cross-section area and thickness, made of another material $M_2$, were $E_2$=1,700 MPa, the deflection caused by the compressive force $F_p$=5 MN changes to the value $\Delta T(E_2)$≈2.7 mm, when $t=t_1$. Since, as can be concluded from formula 1, the value of the deflection ΔT is directly proportional to the thickness t of the lower cushion, it is possible to make, from the material $M_2$, the modulus of elasticity of which is $E_2$, a lower cushion in which the compressive force $F_p$=5 MN creates an equal amount of deflection ΔT, when the thickness of the lower cushion made of the material $M_2$ in question is changed from the thickness value $t=t_1$ to the value $t=t_2$ in proportion with the moduli of elasticity $E_1$ and $E_2$ of the materials $M_1$ and $M_2$ as follows, i.e. a formula derived directly from the formula (1) gives for $t_2$:

$$t_2 = \frac{\Delta T(E_1)}{\Delta T(E_2)} \cdot t_1 = \frac{E_2}{E_1} \cdot t_1 \quad (2)$$

In this case, in order to achieve a compression ΔT=0.44 mm, the thickness $t_2$ of the lower cushion 10 should, according to the formula 2, be, for a material with a modulus of elasticity $E_2$=1,700 MPa, $t_2$=1,700 MPa/1, 100 Mpa*100 mm=153.3 mm, in order for the lower cushion 10 to be compressed by the same amount as a lower cushion 10 made of material with a modulus of elasticity E1=1,100 MPa. Consequently, if a material with a high modulus of elasticity, i.e. a stiff material, is chosen as the material of the lower cushion 10, the thickness of the lower cushion 10 should also increase to achieve a sufficient/suitable amount of flexibility. In general terms, it can be stated that a thick and stiff lower cushion is usually more durable than a thin and soft lower cushion, but increasing the thickness of the lower cushion moves the pile end further down in the drive cap housing. If excessive, this is detrimental, because it weakens the support of the pile and increases the risk of buckling in the area between the hammer and the pile end. Therefore, an optimal solution is sought for each situation, wherein the material properties and the thickness of the lower cushion have been adapted to suit the dimensions of the hammer and the pile, and the intensity of the blows. In terms of the modulus of elasticity E, this has been taken to mean that the suitable value for the modulus of elasticity E in the lower cushion according to the invention varies in the range 500-3,500 MPa. The design of the lower cushion can thus be based on a constant deflection ΔT achieved, for example, through a blow with a specific amount of intensity of the block (and thus through an instantaneous compressive stress caused by it), in which case the thickness t of the lower cushion is determined, for example, using the formulas (1) and (2) described above according to the modulus of elasticity E of the material used for the manufacture.

Figure 5:
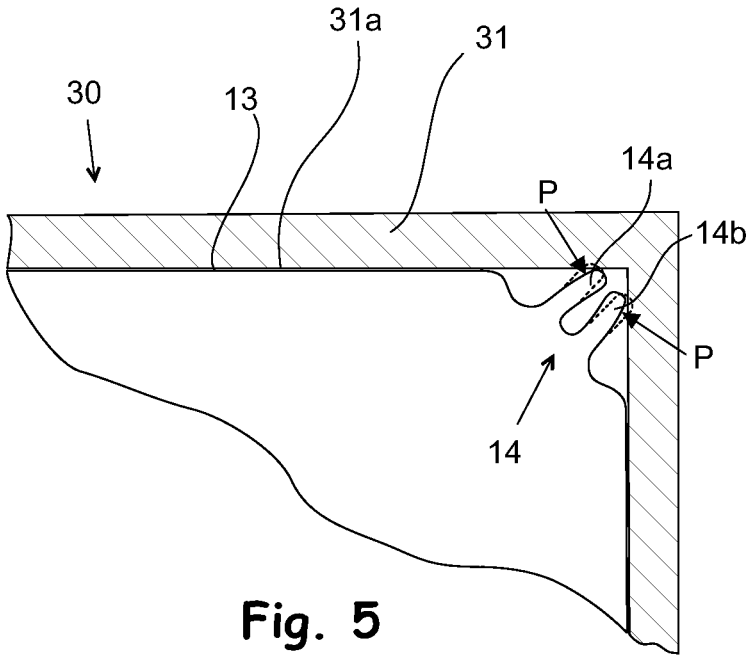
FIG. 5 shows the drive cap housing detail marked with the letter X shown in FIG. 4 when the lower cushion shown in FIGS. 1-4 is fitted in the drive cap housing.

The lower cushion 10 according to FIGS. 1-5 is fitted into the drive cap housing 30 located in the lower part of the hammer of the pile driving rig by using the pile as an aid such that the lower cushion 10 is pushed into the drive cap housing 30 with the help of the pile. This takes place by lifting the pile in a vertical position below the hammer and placing the lower cushion 10 between the upper end of the pile and the drive cap housing 30 and by moving the hammer downwards after that, in which case the lower cushion 10 placed between the pile end and the drive cap housing 30 is pushed to the bottom of the drive cap housing 30. In this case, the top surface 11 of the lower cushion is against the bottom surface of the drive cap located in the upper part of the drive cap housing 30 and the bottom surface 12 against the pile end, and the flexible protuberances 14*a* and 14*b* located in the corners 14 of the lower cushion 10 are compressed against the interior surfaces 31*a* of the side walls 31 of the drive cap housing 30 as shown in FIG. 5. From the enlargement of one of the corners 14 shown in FIG. 5, it can be seen, in particular, how the flexible protuberances 14*a* and 14*b* of the lower cushion 10 fitted into the drive cap housing 30 behave while being inside a drive cap housing 30 for which it is intended. The flexible protuberances 14*a* and 14*b* located in the corners 14 of the lower cushion 10 are bent towards one another to the extent that they can enter between the interior surfaces 31*a* of the side walls 31 of the drive cap housing 30. This elastic deflection causes, between the lower cushion 10 and the interior surfaces 31*a* of the side walls 31 of the drive cap housing 30, a compressive force P which keeps the lower cushion 10 in place in the driving cap housing in the above-described manner.

Figure 6:
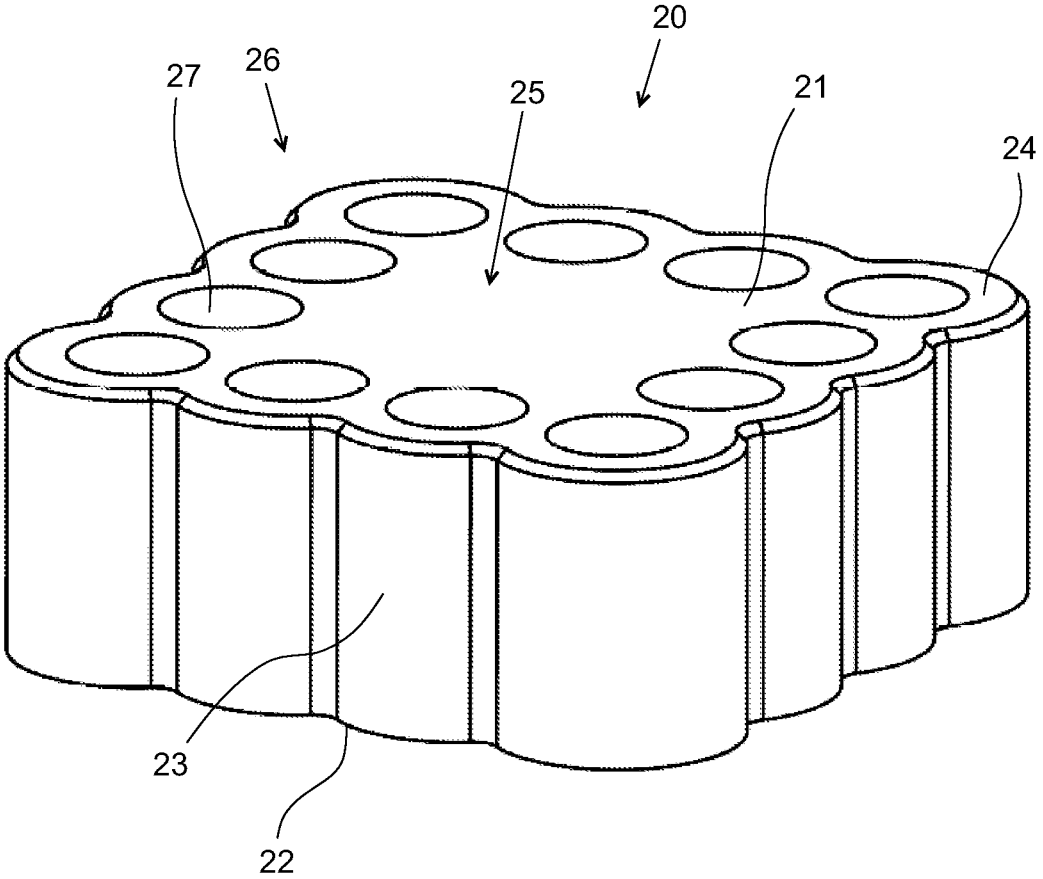
FIG. 6 is an oblique top view of another lower cushion according to the invention
Figure 7:
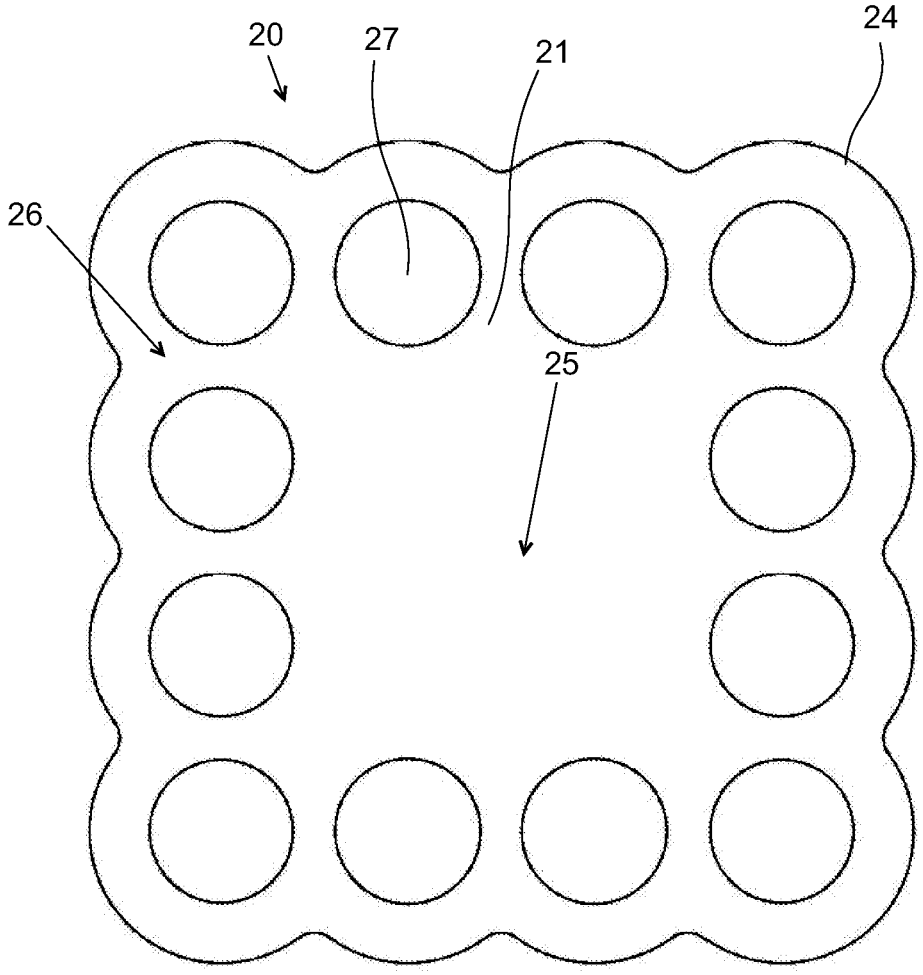
FIG. 7 is an oblique bottom view of the lower cushion according to FIG. 6.
Figure 8:
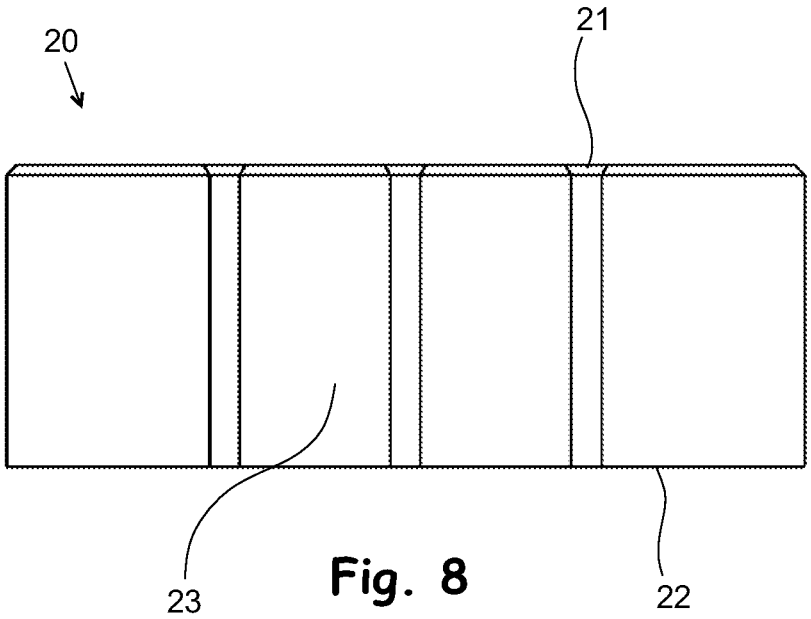
FIG. 8 is a lateral view of the lower cushion according to FIGS. 6 and 7.

FIGS. 6-8 show another lower cushion 20 according to the invention. It also comprises a top surface 21, a bottom surface 22 and four side surfaces 23. Therein, the flexible section has been achieved (seen from above) in the edge areas of the lower cushion by forming a perforated zone 26 between the side surfaces 23 and the centre section 25. In this embodiment, there are, in this area, equally spaced holes 27 that extend through the lower cushion. In this case, the flexible section thus coincides with both the side surfaces 23 and the corners 24, in which case the lower cushion 10 can be compressed at all points at its side surfaces 23 and corners 24 towards the centre section. Consequently, there are several directions of deflection in the lower cushion 20 according to FIGS. 6-8, and the force P, similar to the above embodiment, which keeps the lower cushion 20 in place in the drive cap housing, can be distributed, in the manner determined by the dimensional deviations between the shape of the lower cushion 20 and the interior surfaces of the drive cap housing, across the entire area of the side surfaces 23 and corners 24 of the lower cushion 20.

Also the lower cushion 20 according to the embodiment according to FIGS. 6-8 can be manufactured using the above-mentioned manufacturing methods or machined from a blank of a suitable size and shape by, for example, milling and/or drilling a piece according to the figures from an originally rectangular blank.

Through the design of the side surfaces 23 and corners 24 of the lower cushion 20 according to FIGS. 6-8, the compressive force can be made to grow progressively such that, initially, the protrusions at the holes 27 are easily compressed, but after having straightened, their further compression requires significantly more force. Consequently, it is relatively easy to fit such lower cushion 20 into a drive cap housing, the interior dimensions of which are smaller, by a specific amount, than the lower cushion 20, but at the stage when the interior dimensions of the drive cap housing require that the outward-curved edges of the holes 27 located at the side surfaces 23 of the lower cushion 20 are compressed so as to be straight, the force exerted from the side edges on the interior surfaces of the drive cap housing starts to increase strongly. Consequently, it is advisable to specify the outer dimensions of the embodiment of the lower cushion 20 according to FIGS. 6-8 in relation to the interior dimensions of the drive cap housing such that its side edges are compressed only to the extent that the curved side edges of the holes, located at the holes 27, do not, however, straighten completely when such lower cushion 20 is fitted into the drive cap housing for which it is intended.

Also the suitable thickness of the lower cushion according to FIGS. 6-8 can be determined using the formulas presented above. The influence of the holes 27 on the cross section area of the lower cushion 20 can be taken into account in the calculation. If necessary, the impacts of the different behaviour of the various sections of such lower cushion 20 can also be taken into account, if the holes are so large that they cause bending or distortion of the walls surrounding the holes through the effect of compressive stress, in which case a sole calculation model based on the compression of a straight rod made of monomaterial cannot be applied.

The lower cushion according to the invention can be further implemented in deviation of the example embodiments presented above. The embodiments of the lower cushion according to FIGS. 1-5 and 6-8 are intended for hammers in which the drive cap housing is, in terms of the shape of its cross section perpendicular to the pile driving direction, rectangular or square, in which case the lower cushions 10 and 20 are also, in terms of their cross section perpendicular to their thickness direction, essentially of this shape. However, the lower cushion according to the invention can also be implemented for hammers intended for driving into the ground piles with a cross section of another shape. For example, a lower cushion suitable for drive cap housings with a round cross section is, most suitably, essentially cylindrical in terms of its outer aspect. In such lower cushion, the flexible section can be implemented, for example, in either of the manners presented above, i.e. with the help of the flexible protuberances of the embodiment according to FIGS. 1-5 or the perforation according to FIGS. 6-8. In the embodiment implemented with the help of flexible protuberances, there could be flexible protuberances that are directed outwards from the spherical side surface of the cylindrical lower cushion, for example, at regular distances such that the direction of the flexible protuberances deviates at this point by an angle of a suitable magnitude from the direction of the radius traveling from the side edge of the lower cushion to the centre. In this case, the flexible protuberance always bends into its direction deviating from the direction of the radius when the lower cushion is fitted into the drive cap housing. In one embodiment, these flexible protuberances could be divided into two or more groups such that, in one group, their direction would deviate from the direction of the mentioned radius in a first direction and in the second group, in a second direction, in the third in a third direction, etc. In an embodiment including two groups, the flexible protuberances of the second group could deviate from the direction of the radius by the same amount in the other direction as the direction of the flexible protuberances of the first group deviates in the first direction. In this way, the circumferential forces caused by the bending of the flexible protuberances are caused to annul one another, which means that the shape of the lower cushion is not distorted when compressed. In the case of the perforated version, there could be bulges similar to the embodiment of the lower cushion according to FIGS. 6-8 in the side edge of the lower cushion, i.e. the lower cushion, seen from above, would be shaped like a cycloidal surface in terms of its side surface. On the other hand, the flexible section could be implemented in a rectangular, round or otherwise shaped lower cushion in yet another manner. In some embodiments of the lower cushion, the flexible section could be achieved by, for example, foaming the side edges of the lower cushion (made of, for example, plastic) or by making holes, grooves, recesses or cuts whose shape differ from the round holes in the side edges. Instead of plastic, the material of the lower cushion can be, for example, a composite formed of suitable substances, rubber, neoprene rubber or, for example, a suitable metallic and/or non-metallic alloy, which makes it possible to achieve a material whose modulus of elasticity is 500-3,500 MPa and which, when placed in the drive cap housing of the hammer of the pile driving rig, dampens the vibrations caused by the blows of the block like plastic does, but is fire resistant such that the deformation energy caused by the blows does not cause burning or changes in the properties of the material, in particular flexibility/elasticity, that would impede the functionality of the lower cushion. Also in other lower cushions than those according to FIGS. 1-5 and 6-8, it is possible to use, in determining their thickness, the above-presented methods based on the formulas (1) and (2), or suitably applied methods that make it possible to achieve a thickness suitable for every need based on the values of the thickness of the lower cushion and the modulus of elasticity E of the material used for it. The lower cushion according to the invention is thus not limited to the above-described example embodiments, rather it can be implemented in a number of ways within the following claims.

The invention claimed is:

1. A pile driving rig lower cushion, made of a material having a modulus of elasticity between 500 and 3 500 Mpa, and comprising:

two end surfaces, at least one side surface between the end surfaces, and a thickness between the side surfaces, a first end surface configured to be placed against a drive cap of a pile driving rig, and second end surface configured to be placed against an end of a pile fitted into a drive cap housing, wherein the at least one side surface comprises at least one flexible section that is more flexible in a direction perpendicular to the thickness than remaining sections of the lower cushion in a direction perpendicular to each side surface of the lower cushion for fitting the lower cushion into the drive cap housing, in which there are at least two opposite interior side surfaces, a distance between the at least two opposite interior surfaces is smaller than a distance between two opposite outer surfaces of the lower cushion that come against the at least two interior side surfaces of the drive cap housing, and the at least one flexible section comes against the interior side surfaces of the drive cap housing in a direction of deflection of the at least one flexible section, whereby the lower cushion is fittable between the at least two interior surfaces located in the drive cap housing by compressing the lower cushion at said at least one flexible section in the direction of deflection of the at least one flexible section such that the lower cushion fits between the at least two opposite interior surfaces of the drive cap housing and remains in place between the interior side surfaces through a compressive force P caused by said at least one flexible section compressing against the drive cap housing and resulting friction forces between surfaces that are compressed against one another and, wherein the at least one flexible section has been formed through holes or apertures made in the lower cushion.

2. The pile driving rig lower cushion according to claim 1, wherein the lower cushion is a single monomaterial piece.

3. The pile driving rig lower cushion according to claim 1, wherein the at least one flexible section comprises one of protuberances, holes, apertures, grooves, recesses or cuts.

4. The pile driving rig lower cushion according to claim 1, wherein the at least one flexible section comprises foamed plastic material.

5. The pile driving rig lower cushion according to claim 1, wherein the lower cushion is essentially rectangular in shape.

6. The pile driving rig lower cushion according to claim 5, wherein the at least one flexible section is on the at least one side surface of the lower cushion between two corners of the lower cushion.

7. The pile driving rig lower cushion according to claim 1, wherein the lower cushion is essentially cylindrical in shape.

8. The pile driving rig lower cushion according to claim 7, wherein the at least one flexible section is located on a spherical side surface of the essentially cylindrical lower cushion and comprises at least one protuberance extending outwards from the spherical side surface of the cylindrical lower cushion.

9. The pile driving rig lower cushion according to claim 1, wherein the lower cushion is made of plastic.

10. A pile driving rig lower cushion, made of a material having a modulus of elasticity between 500 and 3 500 Mpa, and comprising:

two end surfaces, at least one side surface between the end surfaces, and a thickness between the at least one side surface, a first end surface configured to be placed against a drive cap of a pile driving rig, and a second end surface configured to be placed against an end of a pile fitted into a drive cap housing, wherein the at least one side surface comprises at least one flexible section that is more flexible in a direction perpendicular to the thickness than remaining sections of the lower cushion in a direction perpendicular to each side surface of the lower cushion for fitting the lower cushion into the drive cap housing, in which there are at least two opposite interior side surfaces, a distance between the at least two opposite interior side surfaces is smaller than the distance between two opposite outer surfaces of the lower cushion that come against the at least two interior side surfaces of the drive cap housing at the at least one flexible section in a direction of deflection of the at least one flexible section, whereby the lower cushion is fittable between the at least two interior surfaces located in the drive cap housing by compressing the lower cushion at said at least one flexible section in the direction of deflection of the at least one flexible section such that the lower cushion fits between said two opposite interior surfaces of the drive cap housing and remains in place between the interior side surfaces through a compressive force P caused by the at least one flexible section compressing against the drive cap housing and resulting friction forces between surfaces that are compressed against one another; and, wherein the thickness of which lower cushion has been determined according to the deflection $\Delta T$ of the lower cushion such that a specific compressive stress $\sigma_p$ prevailing in the direction of thickness of the lower cushion always creates a deflection $\Delta T$ of essentially a same magnitude regardless of a value of the modulus of elasticity E of the material when the value is in the range 500-3,500 MPa.

* * * * *